United States Patent [19]

Cordier et al.

[11] 4,437,651

[45] Mar. 20, 1984

[54] COOLING PLATE FOR BLAST-FURNACES

[75] Inventors: Jean Cordier, Dunkerque; Pierre Rollot, Dunkerque Malo les Bains, both of France

[73] Assignee: Union Siderurgique du Nord et de l'Est de la France, Paris, France

[21] Appl. No.: 319,281

[22] Filed: Nov. 9, 1981

[30] Foreign Application Priority Data

Nov. 7, 1980 [FR] France ..... 8023805

[51] Int. Cl.[3] ..... C21B 7/10

[52] U.S. Cl. ..... 266/193; 122/6 B

[58] Field of Search ..... 266/193; 75/123 CB; 122/6 B; 165/168

[56] References Cited

U.S. PATENT DOCUMENTS 3,953,008 4/1976 Bashinsky et al. ..... 266/193

3,997,338 12/1976 Van Eeghem et al. ..... 75/123 CB 4,121,809 10/1978 Dhelft ..... 266/193

FOREIGN PATENT DOCUMENTS 2804745 8/1979 Fed. Rep. of Germany ..... 266/241

312876 8/1971 U.S.S.R. ..... 266/193

506629 4/1976 U.S.S.R. ..... 266/193

*Primary Examiner*—M. J. Andrews

*Attorney, Agent, or Firm*—Cushman, Darby & Cushman

[57] ABSTRACT

The plate comprises a cast iron element of substantially parallelepipedic shape. Cooling tubes which are disposed parallel to one another, embedded in the element and extend longitudinally of the element, issue from the latter on the same main side, respectively in the upper and lower parts of the element, in a protective sleeve. The side of the element opposed to the main side from which the cooling tube issue has a waffle shape.

5 Claims, 3 Drawing Figures

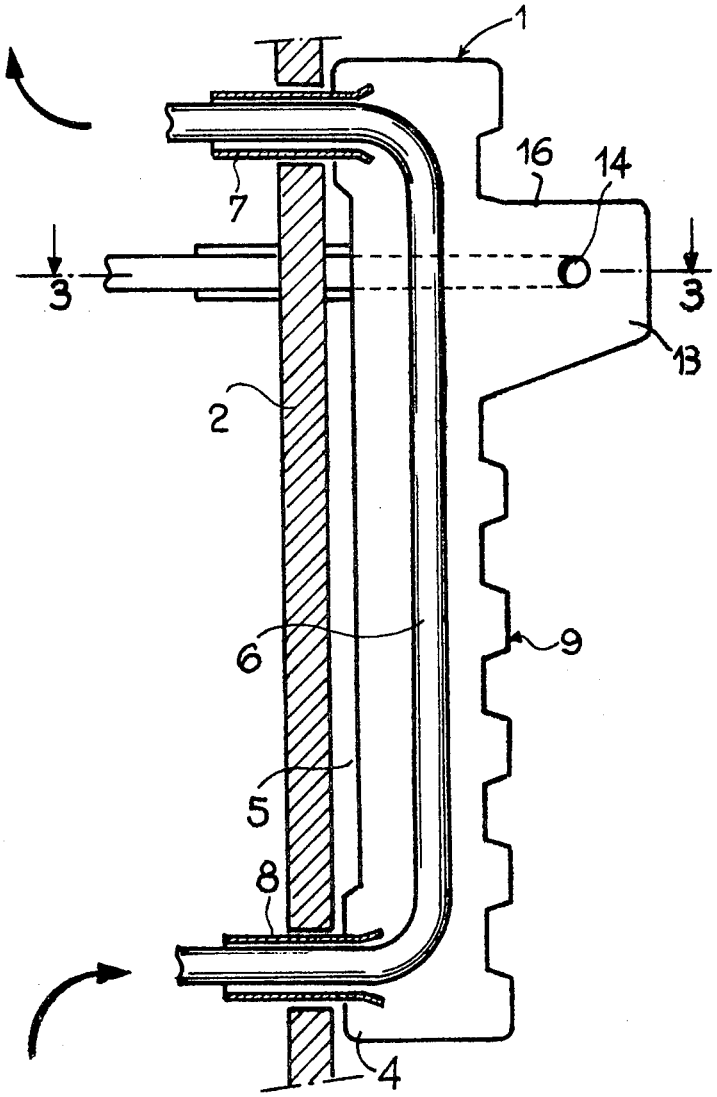
FIG.2
FIG.3
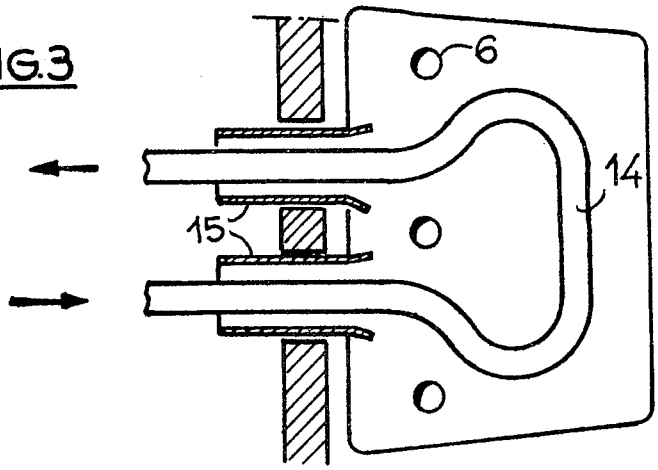

COOLING PLATE FOR BLAST-FURNACES

DESCRIPTION

The present invention relates to cooling plates for blast-furnaces.

These cooling plates are elements placed against the inner side of the armour and perform the double function of cooling of the refractory lining and a screen against the passage of the flow of heat in the armour.

The use of such cooling plates disposed between the inner wall of the armour and the refractory lining is necessary due to the increase in the heat flows and in their transfer pursuant to modern methods of using blast-furnaces.

The cooling plates are formed by cast iron elements within which extends a series of tubes through which flows a cooling fluid, usually water. These cooling tubes emerge in the upper and lower ends of the cooling plates, pass through the armour, and are connected to the cooling tubes of an upper or lower adjacent plate. The tubes connected together in this way define the paths of fluid circulation which rise substantially vertically along the wall of the blast-furnace, these lines being connected to an exterior fluid circulating and cooling circuit.

The cooling plates must be designed in such a way that they withstand the heat and mechanical deformation resulting from high fluxes in the blast-furnaces and, moreover, in such a way as to ensure efficient heat exchange with the refractory lining and ensure the effective attachment of the lining.

Cooling plates known in the prior art do not fully satisfy these conditions and possess defects which owing to repeated thermal stresses, result in the formation of cracks in their thickness and, consequently, in the release of water in the blast-furnace in the form of leakage of the cooling fluid and in a poor mechanical behaviour of the cooling tubes in the region where they issue from the cooling plates and pass through the armour. Moreover, there appears to be a difficulty in permanently fixing the refractory lining to the cooling plates.

An object of the present invention is to overcome these drawbacks and to provide cooling plates having improved operational safety, improved heat exchange characteristics, and attach to the refractory lining in an improved manner.

The present invention therefore provides a cooling plate comprising a cast iron element of substantially parallelepipedic shape, in which are embedded longitudinal tubes disposed parallel to each other, said tubes issuing from a common main side in the upper and lower ends of the cooling plates in a protective sleeve, wherein the side opposed to that from which the cooling tubes issue has a waffle shape.

According to another feature of the present invention, the transverse grooves of the side having the waffle shape include inserts of silicon carbide.

According to another feature of the invention, the side having the waffle shape includes a projecting part termed a lip. This lip is disposed in the upper part or in a median part of the waffle-shaped side or may constitute the upper edge of the cooling plate.

Further features and advantages of the invention will be apparent from the following description with reference to the accompanying drawings in which:

FIG. 2 is an end elevational view, partly in section, of a cooling plate with a lip, and FIG. 3 is a sectional view taken on line 3—3 of FIG. 2.

Figure 1:
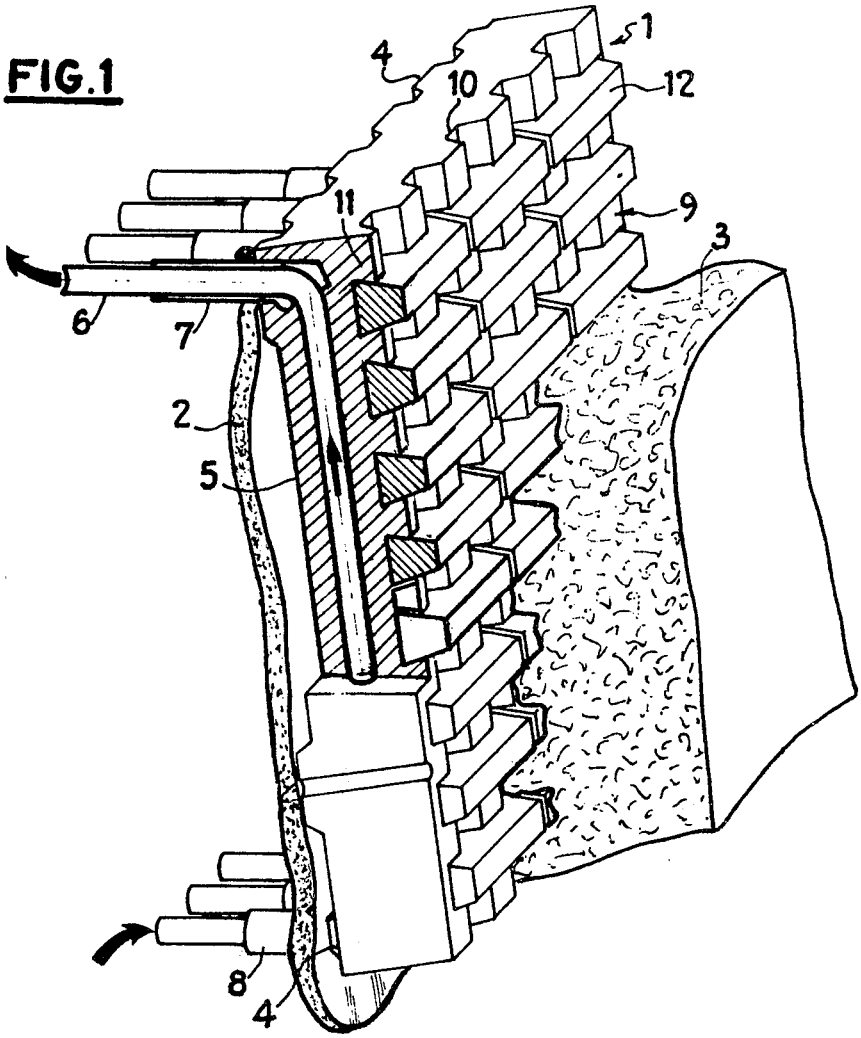
FIG. 1 is a perspective view, with a part cut away, of a cooling plate placed between the armour and the refractory lining.

In FIG. 1, the cooling plate 1 is disposed vertically between the armour 2 of the blast-furnace and the refractory lining 3. The cooling plate 1 bears against the inner wall of the armour by bosses 4 which form projections on side 5 facing the armour.

Extending through the cooling plate are longitudinal cooling fluid circulating tubes 6 which are parallel to each other and extend along a vertical longitudinal axis. The tubes 6 issue from the plate 1 in the upper and lower parts respectively in sleeves 7 and 8 which are embedded in the cast iron of the cooling plate.

The part of the cooling tubes issuing from the plates and their sleeves are disposed in such manner that they are exactly horizontal, ie. they are slightly inclined relative to the perpendicular to the surface of the armour at the point at which the latter is traversed by the tubes.

The side 9 of the cooling plate opposed to the side 5 which is the side from which the cooling tubes issue from the plate, has a waffle shape. This waffle shape is obtained by the crossing at a right angle of longitudinal grooves 10 and transverse grooves 11, the longitudinal grooves 10 being parallel to the tubes 6. The grooves may have a square, rectangular or trapezoidal cross-sectional shape.

In the embodiment shown in FIG. 1, the longitudinal grooves 10 have a trapezoidal cross-sectional shape the divergent part of which faces outwardly of the plate whereas the transverse grooves 11 have a trapezoidal cross-sectional shape disposed as a dovetail. Placed in these transverse grooves are inserts 12 having a corresponding trapezoidal cross-sectional shape and projecting from the waffle-shaped side 9 of the cooling plate.

These inserts are made from silicon carbide and placed in situ when casting the iron of the cooling plate. This feature of the casting of the iron around blocks of special silicon carbide results in an intimate contact, ensured by a chemical bond, between the silicon carbide and the cast iron which guarantees an excellent coefficient of heat transfer between the two materials.

In the cooling plate shown in FIG. 1, all the transverse grooves include silicon carbide inserts, but it is possible to space these inserts apart in every two or three grooves and even to provide no insert. The transverse grooves which do not have an insert may have a trapezoidal cross-sectional shape whose divergent part faces outwardly from the plate.

The waffle shape of the side 9 facing the refractory lining increases the interface between the refractory lining and the cast iron and consequently facilitates the heat exchange. It also performs the function of a mechanical anchoring of the refractory lining inside the blast-furnace.

Thermomechanical stresses are avoided, which would otherwise result in deformation of the cooling plates and consequent cracking.

The silicon carbide inserts improve the connection between the cast iron and the refractory lining. Further, in the case of the disappearance of the refractory lining in the course of operation of the blast-furnace, these elements promote a self-lining and provide a resistance to abrasion.

FIG. 2 shows in section a cooling plate of the type having a lip. The cooling plate, as in the general case shown in FIG. 1, is disposed against the inner side of the armour 2. Longitudinal cooling tubes 6 are embedded within the mass of cast iron of the cooling plate and issue therefrom in the upper and lower parts in protective sleeves 7 and 8 which extend through the armour 2. Bosses 4 projecting from the side 5 of the cooling plate facing the armour, act as a support against the latter. Seals (not shown), as in the case of FIG. 1, are disposed between the bosses 4 and the armour of the blast-furnace 2. Further, masses of filler adapted to ensure a solution of continuity between the refractory lining, the cooling plate and armour system, are disposed between the side 5 of the cooling plate and the armour. The cooling plate is maintained tightly against the armour by means outside the latter (not shown).

A lip 13 projecting from the waffle-shaped side 9 of the cooling plate includes, embedded therein a cooling fluid circulating transverse tube 14 which issues from the side 5 facing the armour through of protective sleeves 15 which are embedded in the metal mass of the cooling plate and extend through the armour 2.

It can be seen in FIG. 3 that the transverse tube is so disposed that it passes between the longitudinal cooling fluid circulating tubes 6. The transverse tubes 14 are connected outside the blast-furnace to other similar tubes cooling the lips of other upper and lower cooling plates. The circuit of the transverse cooling tubes is also connected to an exterior cooling fluid circulating circuit.

The lips may include a cooling tube as shown in FIGS. 2 and 3, but it is also possible to provide a plurality of cooling tubes, depending on the size of the lip. This lip may be disposed in a part which is slightly lower than the upper edge of the cooling plate or in a more median part thereof, or may constitute the upper edge of the cooling plate.

Thus, in the areas corresponding to the base of the shaft, the middle of the shaft and the shaft, the lips are arranged below the upper edge of the cooling surface or in a more median area, while in the last row located in the zone of the shaft, the lip forms the upper edge of the cooling plates.

The lips may also include inserts of CSi in grooves provided for this purpose.

The lips 13 have an upper face 16 substantially perpendicular to the waffle-shaped side 9 so that it is substantially horizontal when the cooling plate is in position in the blast-furnace.

The function of these lips is to support the refractory lining and to facilitate a self-lining after the refractory lining has disappeared.

The cooling plates comprise a number of longitudinal cooling tubes 6 which may vary in number from 3 to 5. The density of the inner cooling tubes varies as a function of the heat flux in the blast-furnace and, of course, the greater this heat flow the smaller the distance between the axes of the tubes. By way of example, in cooling plates at the level of the belly, tubes are provided with a pitch of 195 to 210 mm, while in the less stressed zones of the shaft, this pitch is increased to 270 to 320 mm.

The dimensions of the plates are also a function of the heat flow emitted in the various zones of the blast-furnace. In the zones having intense thermal stress where the density of the internal tubes is high, ie. their pitch is small, smaller cooling plates are used having the same number of tubes as those in the zones subjected to a less intense heat flow.

According to another feature of the invention, the cooling plates are made from cast iron which must possess, in addition to inherent qualities of this material, characteristics suitable for its specific utilization.

This cast iron must:

have the best possible conductivity, retain between 300° and 500° C. physical and mechanical qualities of strength, hardness, elasticity, retain its metallographic and geometric stability by delaying the transformations which occur at elevated temperature and which may result in a swelling of the cast iron, resist chemical attack and, in particular, those of alkaline vapours such as potassium compounds.

According to the zones and the type of cooling plates constructed, three qualities of chromium iron are employed:

(a) cast iron having a high conductivity for the normally stressed zones;

(b) stabilized lamellar graphite type A cast iron for the mid and highly stressed zones;

(c) aluminum cast iron for the very exposed zones (for example those of the bottom of the shaft).

All these cast irons have a good resistance to attack by alkaline vapours.

The irons of typs (a) and (b) have the following analysis in percentage by weight:

C=3.65±0.25

Si=1.65±0.25

Mn=1.00±0.20

Cr=0.65±0.15

Ni=0.25±0.05

P—≦0.22

S—≦0.10

The cast irons of the types (a) and (b) only differ in their crystallographic structure. The iron of type (b) is a predominant controlled rounded lamellar graphite cast iron of type A which is stabilized and highly conductive. This special crystallographic structure is obtained by a selected charging, a control of the superheating and by inoculation.

The cast iron of type (c) including aluminium has the following analysis in percentage by weight:

C=2 to 4

Al=1 to 3

Si=0 to 1

Mn=0 to 0.7

S=0 or 0.05

P=0 to 0.01

Inoculation agent based on an alloy of Cr expressed in Cr:0.3 to 2%.

There may also be employed as an inoculation agent an alloy based on copper and rare earths in which the proportion of cerium in the rare earths is 50%, the proportion of Cu and of the rare earths in the alloy being identical to that defined for the Cr.

This aluminium cast iron does not harden, it retains its conductivity and its mechanical resistance to abrasion and to cracking at elevated temperature.

The cast iron of type (c) is employed in the regions of the blast-furnace which are the most stressed by the heat flows and by the effect of mechanical abrasion, in particular for the cooling plates having lips of the bottom of the shaft and of the belly part.

As a specific example of an aluminium cast iron of type (c), the iron has the following composition in percentage by weight:

C=3.8

Al=2.3

Si=0.6

Mn=0.4

S=0.065

P=0.005

Cr=0.3.

Having now described our invention what we claim as new and desire to secure by Letters Patent is:

1. A cooling plate arrangement for use in a blast furnace, the plate being of cast iron and having a plurality of longitudinally arranged cooling tubes disposed within said plate and issuing from said plate on a common first side of said plate in the region of the upper and lower ends of said plate, said cooling plate arrangement further having a refractory lining afixed to a second side of said plate, said second side being opposite said first side, the improvement comprising means for adapting to horizontal and vertical deformations in said plate, said adapting means including a series of longitudinally and horizontally arranged grooves, in the surface of said second side, crossing at generally right angles to each other, with the areas between the grooves forming projections, so that the grooves facilitate the bending without cracking of the plate in response to heat engendered deformations in the horizontal and vertical directions and simultaneously improve the afixing of said refractory lining to said second side of said plate.

2. The arrangement according to claim 1, including silicon carbide inserts afixed within at least one of the said horizontal grooves, said inserts being arranged in rows.

3. A cooling plate structure according to claim 1, wherein said plate is made from a cast iron having a high heat conductivity and consisting essentially of the following composition in percentage by weight:

C=3.65±0.25

Si=1.65±0.25

Mn=1.00±0.20

Cr=0.65±0.15

Ni=0.25±0.05

P−≦0.22

S−≦0.10 balance iron.

4. A cooling plate structure according to claim 3, wherein the crystallographic structure of said cast iron is a predominantly controlled rounded lamellar graphite cast iron of type A.

5. A cooling plate structure according to claim 1, wherein said plate is made from a non-hardening aluminium cast iron consisting essentially of a high heat conductivity and the following composition in percentage by weight:

C=2 to 4

Al=1 to 3

Si=0 to 1

Mn=0 to 0.7

S=0 to 0.05

P=0 to 0.01

Inoculation agent based on an alloy of Cr, expressed in Cr=0.3 to 2% balance iron.

* * * * *